US006607367B1

(12) United States Patent
Shibamoto et al.

(10) Patent No.: US 6,607,367 B1
(45) Date of Patent: Aug. 19, 2003

(54) SCROLL TYPE COMPRESSOR

(75) Inventors: Yoshitaka Shibamoto, Sakai (JP); Mikio Kajiwara, Sakai (JP); Hiroshi Kitaura, Sakai (JP); Suguru Ishiguro, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 47 days.

(21) Appl. No.: 09/890,884

(22) PCT Filed: Oct. 4, 2000

(86) PCT No.: PCT/JP00/06927

§ 371 (c)(1),
(2), (4) Date: Aug. 6, 2001

(87) PCT Pub. No.: WO01/42658

PCT Pub. Date: Jun. 14, 2001

(30) Foreign Application Priority Data

Dec. 6, 1999 (JP) ..... 11-346254

(51) Int. Cl.[7] ..... F04B 49/00
(52) U.S. Cl. ..... 417/310; 417/410.5
(58) Field of Search ..... 417/310, 410.5, 417/426, 301, 287; 418/55.5

(56) References Cited

U.S. PATENT DOCUMENTS 4,496,296 A 1/1985 Arai et al.
5,613,841 A * 3/1997 Bass et al. ..... 417/310
6,086,335 A * 7/2000 Bass et al. ..... 417/220
6,478,550 B2 * 11/2002 Matsuba et al. ..... 417/310
6,514,060 B1 * 2/2003 Ishiguro et al. ..... 418/55.5

FOREIGN PATENT DOCUMENTS

| | | |
|---|---|---|
| JP | 58-122386 | 7/1983 |
| JP | 6-26470 | 2/1994 |
| JP | 6-330864 | 11/1994 |
| JP | 10-110689 | 4/1998 |

* cited by examiner

*Primary Examiner*—Teresa Walberg
*Assistant Examiner*—Vinod D Patel
(74) *Attorney, Agent, or Firm*—Burns, Doane, Swecker & Mathis, LLP

(57) ABSTRACT

A fixed scroll (2) and a movable scroll (4) form a compression chamber (16). A first back pressure chamber (14) is formed on the back surface of the movable scroll (4). The first back pressure chamber receives a fluid of a discharge pressure. An unloader mechanism (11) is provided for guiding refrigerant gas from the compression chamber **(16*a*) in the process of compression toward a suction port (13). A control part (31) is provided for controlling the unloader mechanism (11)**. When separating force is to exceed pressing force, the control part detects this and operates the unloader part for guiding the fluid from the compression chamber in the process of compression toward the suction part. Thus obtained is a scroll compressor attaining relatively sufficient pressing force by reducing separating force also when pressing force is reduced and suppressing internal leakage.

10 Claims, 8 Drawing Sheets

SCROLL TYPE COMPRESSOR

TECHNICAL FIELD

The present invention relates to a scroll compressor, and more particularly, it relates to a scroll compressor improving sealability between a fixed scroll and a movable scroll and suppressing internal leakage.

BACKGROUND ART

A scroll compressor described in Japanese Patent Laying-Open No. 6-330864 (1994) is now described as an example of a conventional scroll compressor.

Referring to FIG. 8, a movable scroll 103 and a fixed scroll 102 are supported on an upper portion in a casing 101 of the scroll compressor. Movable scroll teeth 132 project from an end plate 131 of the movable scroll 103. Fixed scroll teeth 122 project from an end plate 121 of the fixed scroll 102. The movable scroll teeth 132 and the fixed scroll teeth 122 fit with each other thereby forming a compression chamber.

A suction port 180 for introducing refrigerant gas fed from a suction pipe 107 into the compression chamber is provided on the outer peripheral portion of the fixed scroll 102. A discharge port 123 for discharging the refrigerant gas compressed to a high-pressure state is formed around the center of the fixed scroll 102.

A motor 104 is provided on a lower portion in the casing 101. A drive shaft 141 extending from the motor 104 is supported by a bearing housing 105 fixed to the lower portion of the movable scroll 103. A boss 133 provided on the end plate 131 of the movable scroll 103 is engaged with an upper end portion of the drive shaft 141.

A back pressure chamber 109 is formed between the bearing housing 105 and the movable scroll 103. A high pressure (discharge pressure) acts on the back pressure chamber 109. A seal ring 170 is provided between the movable scroll 103 and the bearing housing 105.

This seal ring 170 seals the back pressure chamber 109 of a high pressure and a space of a low pressure (suction pressure) provided with the movable scroll 103 and the fixed scroll 102. Therefore, it follows that the discharge pressure acts on a region of the back surface of the end plate 131 of the movable scroll 103 located inside the seal ring 170 and the suction pressure acts on another region of the back surface located outside the seal ring 170.

The end plate 121 of the fixed scroll 102 is provided with a relief port 110 and a relief valve 111 for discharging the refrigerant gas from the compression chamber in the process of compression into a discharge chamber 101A in order to prevent over-compression.

A cover body 124 covering the upper side of the discharge port 123 is mounted on the fixed scroll 102 with fixing bolts. The cover body 124 is coupled to a support plate 106 fixed to the upper portion in the casing 101. The support plate 106 is provided with a communication hole 161 communicating with the discharge port 123.

A communication path 101C connects the discharge chamber 101A of the casing 101 communicating with the communication hole 161 with a space 101B located below the bearing housing 105. The space 101B communicates with a discharge pipe 108 for discharging the refrigerant gas of a high pressure from the casing 101.

Operation of the aforementioned scroll compressor is now described.

Following rotation of the motor 104, the movable scroll 103 revolves with respect to the fixed scroll 102 so that the compression chamber formed by the movable scroll teeth 132 and the fixed scroll teeth 122 spirally contractedly moves from the outer peripheral portion toward the central portion.

Thus, the refrigerant gas of a low pressure fed into the compression chamber from the suction pipe 107 through the suction port 180 is compressed to a high-pressure state. The high-pressure refrigerant gas is discharged from the discharge port 123 and flows into the space 101B through the communication hole 161, the discharge chamber 101A and the communication path 101C. The discharge pipe 108 discharges the refrigerant gas flowing into the space 101B from the casing 101.

The pressures acting on the end plate 131 of the movable scroll 103 in the aforementioned operations are now described. The pressure of the fluid in the compression chamber as well as a back surface pressure act on the end plate 131. FIG. 9 typically shows pressure distribution in the compression chamber and pressure distribution on the back surface with respect to positions of the end plate 131.

As hereinabove described, the compression chamber spirally contractedly moves from the outer peripheral portion toward the central portion. Therefore, the pressure of the compression chamber increases from the outermost peripheral portion in a suction process toward a portion in a discharge process through a portion in the process of compression.

Therefore, the portion of the compression chamber in the suction process has the lowest pressure, i.e., a suction pressure Ps, and the portion in the discharge process has the highest pressure, i.e., a discharge pressure Pd. The portion of the compression chamber in the process of compression exhibits a pressure Pm between the suction pressure Ps and the discharge pressure Pd.

Thus, it follows that force (separating force) for separating the movable scroll 103 from the fixed scroll 102 acts on the end plate 131 of the movable scroll 103 on the basis of the aforementioned pressures.

On the other hand, the discharge pressure Pd acts on the region of the back surface of the end plate 131 located inside the seal ring 170 while the suction pressure Ps acts on the region located outside the seal ring 170, as hereinabove described.

Thus, it follows that force (pressing force) for pressing the movable scroll 103 against the fixed scroll 102 acts on the end plate 131 of the movable scroll 103 oppositely to the separating force, on the basis of the aforementioned pressures.

When the scroll compressor is operated at a standard operating pressure ratio, the pressures are distributed as shown in FIG. 9. In this case, therefore, sufficient pressing force is attained as compared with the separating force for preventing separation of the movable scroll 103 from the fixed scroll 102. The scroll teeth 122 and 132 come into close contact with the end plates 121 and 131 respectively, to be capable of suppressing internal leakage.

The operating pressure ratio, depending on a refrigerating cycle of the scroll compressor including an evaporator and a condenser, is obtained by dividing the discharge pressure Pd depending on a condensing pressure by the suction pressure Ps depending on an evaporating pressure.

At the standard operating pressure ratio, this value is at the same level as a designed pressure level decided by the scroll teeth 122 and 132, more specifically in the range of about 2 to 5.

As hereinabove described, sufficient pressing force is attained as compared with the separating force to be capable of suppressing internal leakage when the scroll compressor is operated at the standard operating pressure ratio.

When the scroll compressor is operated at a low operating pressure ratio of not more than about 2, however, the following problem arises: Such an operating pressure ratio is less than the designed pressure ratio. More specifically, the suction pressure Ps is relatively increased as compared with the discharge pressure Ps or the discharge pressure Pd is relatively reduced as compared with the suction pressure Ps at such an operating pressure ratio. In this case, therefore, the pressure of the compression chamber in the process of compression may exceed the reduced discharge pressure.

Pressure distribution in the compression chamber and pressure distribution on the back surface with respect to the positions of the end plate 131 with such a low operating pressure ratio are now described. As shown in FIG. 10, the portion of the compression chamber in the suction process exhibits the lowest pressure, i.e., the suction pressure Ps, while the portion in the process of compression exhibits the highest temperature, i.e., the pressure Pm. The portion in the discharge process exhibits the discharge pressure Pd between the suction pressure Ps and the pressure Pm. It follows that separating force acts on the end pressure 131 on the basis of these pressures.

On the other hand, the discharge pressure Pd acts on the region of the end plate 131 located inside the seal ring 170 as back pressure force, while the suction pressure Ps acts on the region located outside the seal ring 170. It follows that pressing force acts on the end plate 131 on the basis of these pressures.

Comparing the separating force with the pressing force, the former is insufficient with respect to the latter since the discharge pressure Pd is lower than the pressure Pm of the portion in the process of compression. Therefore, the scroll teeth 122 and 132 may not be in close contact with the end plates 121 and 131 respectively but internal leakage may take place from the high-pressure side toward the low-pressure side of the compression chamber.

When the pressure in the portion of the compression chamber in the process of compression exceeds a prescribed level (over-compression) in the aforementioned scroll compressor, the relief valve 111 can be open for discharging the refrigerant gas from the compression chamber into the discharge chamber 101A through the relief port 110. Thus, it follows that the pressure in the portion of the compression chamber in the process of compression is reduced to about the discharge pressure Pd.

In the portion of the compression chamber following (outside) the portion communicating with the relief port 110, however, the pressure is higher than the suction pressure Ps. Although the pressure of the portion of the compression chamber communicating with the relief port 101 is reduced to about the discharge pressure Pd, therefore, the pressing force is still so insufficient with respect to the separating force that internal leakage may take place.

DISCLOSURE OF INVENTION

The present invention has been proposed in order to solve the aforementioned problem, and an object thereof is to provide a scroll compressor capable of attaining sufficient pressing force with respect to separating force and reducing internal leakage.

A scroll compressor according to a first aspect of the present invention comprises a fixed scroll and a movable scroll, a suction port, a discharge port, an unloader part, control means and a first back pressure chamber. The fixed scroll and the movable scroll form a compression chamber. The suction port feeds a fluid into the compression chamber. The discharge port discharges the fluid compressed in the compression chamber. The unloader part guides the fluid from the compression chamber in the process of compression toward the suction port. The control means operates the unloader part. The first back pressure chamber is provided on the back surface of either the fixed scroll or the movable scroll for receiving the fluid, having a discharge pressure, discharged from the discharge port. The control means detects, calculates or predicts a suction pressure and the discharge pressure, compares separating force for separating the fixed scroll and the movable scroll from each other with pressing force for pressing one of the scrolls against the other scroll on the basis of the detected, calculated or predicted suction pressure and discharge pressure and operates the unloader part when the pressing force is insufficient or to be insufficient with respect to the separating force for releasing the fluid from the compression chamber in the process of compression toward the suction port.

When the scroll compressor is operated at a low operating pressure ratio and separating force is to exceed pressing force due to over-compression or the like, for example, the control part detects this and operates the unloader part for guiding the fluid from the compression chamber in the process of compression toward the suction port. Thus, relatively sufficient pressing force is attained due to reduction of the separating force also when the pressing force is reduced, so that the compression chamber can be inhibited from internal leakage. Further, the over-compression can be relaxed.

Preferably, the control means of the scroll compressor calculates the discharge pressure and the suction pressure from the temperatures of the fluid flowing through an evaporator and a condenser connected between a discharge pipe delivering the discharged fluid and a suction pipe receiving the fluid respectively on the outside of a casing respectively.

In this case, an evaporating pressure and a condensing pressure are uniquely obtained from an evaporating temperature obtained from the temperature of the fluid flowing through the evaporator and a condensing temperature obtained from the temperature of the fluid flowing through the condenser respectively. The evaporating pressure and the condensing pressure are substantially equal to the suction pressure and the discharge pressure respectively. Thus, the suction pressure and the discharge pressure can be readily obtained by measuring the temperature of the fluid flowing through the evaporator and the temperature of the fluid flowing through the condenser.

Preferably, the unloader part of the scroll compressor has a first switching part provided on an intermediate portion of a first passage connecting the compression chamber in the process of compression with a region located on the side of the suction port for opening/dosing the first passage with the fluid of the discharge pressure or the fluid of the suction pressure, for opening the first switching part by guiding the fluid of the suction pressure to the first switching part and closing the first switching part by guiding the fluid of the discharge pressure to the first switching part.

In this case, the first switching part can be readily opened/closed by switching the fluid of the discharge pressure and the fluid of the suction pressure through the pressure of the fluid.

More preferably, the scroll compressor further comprises a second back pressure chamber receiving the fluid of the discharge pressure in a decompressed state on the back surface of the scroll provided with the first back pressure chamber.

In this case, the fluid of the discharge pressure is decompressed so that the pressure in the second back pressure chamber reaches a level between the discharge pressure and the suction pressure. Thus, more sufficient pressing force is attained as compared with the case where the second back pressure chamber is at the suction pressure, so that internal leakage can be effectively suppressed. Further, the pressing force is reduced when the scroll compressor is operated at a general operating pressure ratio as compared with the case of setting the first and second back pressure chambers entirely to the suction pressure, and hence one of the scrolls is not excessively pressed against the other scroll.

Preferably, the scroll compressor further comprises a sealing member sealing the first back pressure chamber and the second back pressure chamber, and the fluid of the discharge pressure is decompressed by flowing from the first back pressure chamber into the second back pressure chamber through a clearance in the vicinity of the sealing member.

In this case, the fluid can be readily decompressed without requiring a complicated mechanism.

More preferably, an electric motor for driving the movable scroll is a variable-speed electric motor.

In this case, defrost operation, for example, can be ended in a short time by increasing the rotational frequency of the electric motor.

Preferably, the scroll compressor further comprises a relief port for directly guiding the fluid from the compression chamber in the process of compression to a region located on the side of the discharge port and a relief valve provided on an intermediate portion or the outlet of the relief port for opening the relief port when the pressure in the compression chamber in the process of compression exceeds the pressure on the side of the discharge port.

When the operating pressure ratio is extremely small, over-compression may take place despite operation of the unloader part. In this case, the fluid is released toward the region located on the side of the discharge port from the compression chamber causing over-compression, so that the over-compression can be relaxed.

A scroll compressor according to a second aspect of the present invention comprises a fixed scroll and a movable scroll, a suction port, a discharge port, an unloader part and a first back pressure chamber. The fixed scroll and the movable scroll form a compression chamber. The suction port sucks a fluid into the compression chamber. The discharge port discharges the fluid compressed in the compression chamber. The unloader part guides the fluid from the compression chamber in the process of compression toward the suction port. The first back pressure chamber is provided on the back surface of either the fixed scroll or the movable scroll for receiving the fluid, having a discharge pressure, discharged from the discharge port. The unloader part includes a switching part opened/closed by working the discharge pressure on one side of a piston part while working a suction pressure and elastic force on another side, for guiding the fluid from the compression chamber toward the suction port when the discharge pressure is smaller than the suction pressure and the elastic force.

When the scroll compressor is operated at a low operating pressure ratio and the discharge pressure is reduced below the suction pressure and the elastic force due to over-compression or the like, the switching part is automatically open to operate the unloader part thereby guiding the fluid from the compression chamber in the process of compression toward the suction port. Thus, relatively sufficient pressing force is attained due to reduction of separating force also when the pressing force is reduced, so that the compression chamber can be inhibited from internal leakage. Further, the over-compression can be relaxed.

Preferably, the scroll compressor further comprises a second back pressure chamber provided on the back surface of the scroll provided with the first back pressure chamber for receiving the fluid of the discharge pressure in a decompressed state.

In this case, the fluid of the discharge pressure is decompressed so that the pressure in the second back pressure chamber reaches a level between the discharge pressure and the suction pressure. Thus, more sufficient pressing force is attained as compared with the case where the second back pressure chamber is at the suction pressure, so that internal leakage can be effectively suppressed. Further, the pressing force is reduced when the scroll compressor is operated at a general operating pressure ratio as compared with the case of setting the first and second back pressure chambers entirely to the suction pressure, and hence one of the scrolls is not excessively pressed against the other scroll.

Preferably, the scroll compressor further comprises a sealing member sealing the first back pressure chamber and the second back pressure chamber, and the fluid of the discharge pressure is preferably decompressed by flowing from the first back pressure chamber into the second back pressure chamber through a clearance in the vicinity of the sealing member.

In this case, the fluid can be readily decompressed without requiring a complicated mechanism.

The foregoing and other objects, features, aspects and advantages of the present invention will become more apparent from the following detailed description of the present invention when taken in conjunction with the accompanying drawings.

BEST MODE FOR CARRYING OUT THE INVENTION

First Embodiment

Figure 1:
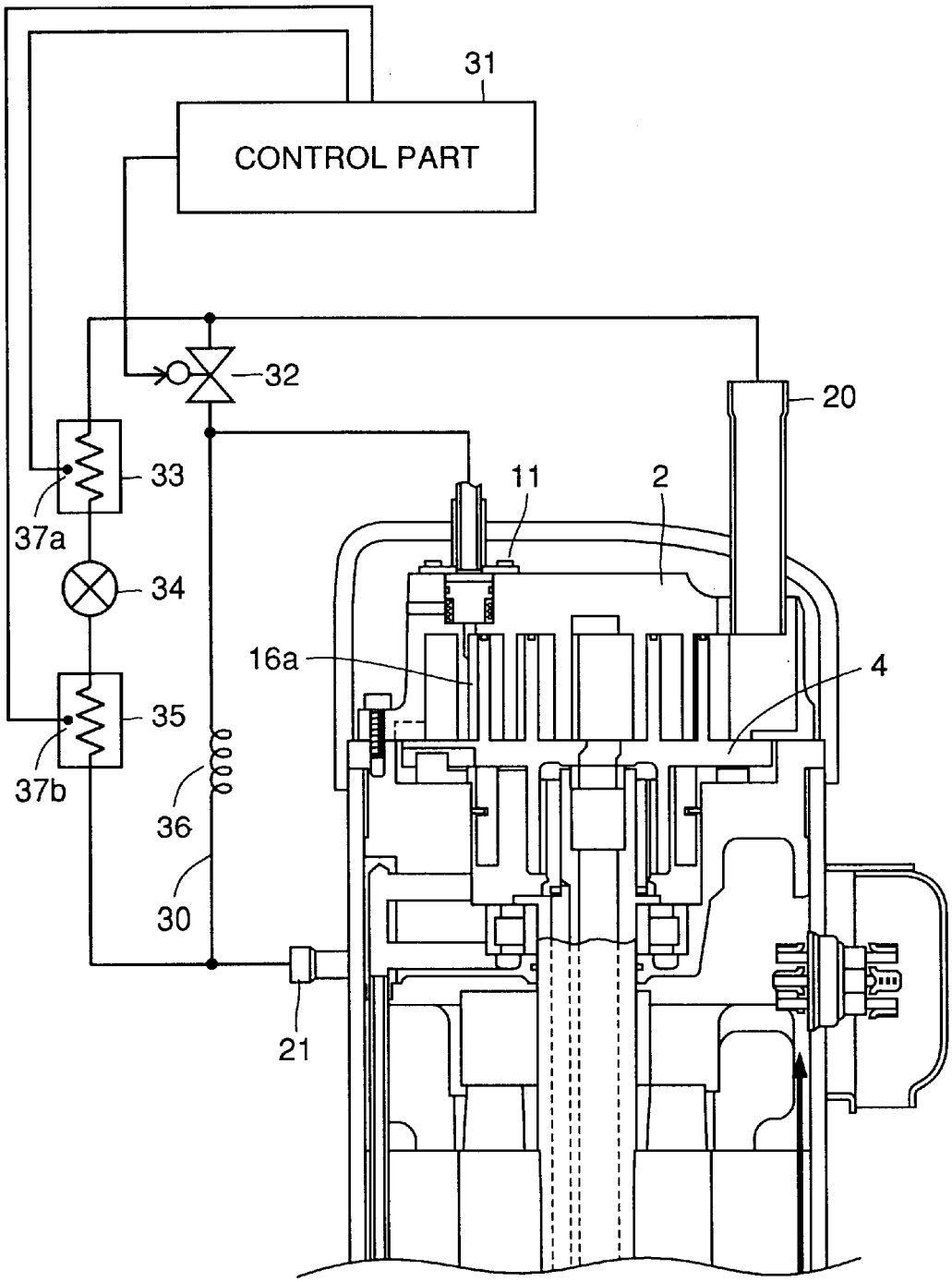
FIG. 1 illustrates the structure of a refrigerating cycle including a scroll compressor according to a first embodiment of the present invention.

A scroll compressor 1 according to a first embodiment of the present invention is now described. First, the structure of a refrigerating cycle including the scroll compressor 1 is described. Referring to FIG. 1, the refrigerating cycle is generally formed by four main apparatuses, i.e. the scroll compressor 1, a condenser 35, an expansion valve 34 and an evaporator 33.

An end of the condenser 35 is connected to a discharge pipe 21 of the scroll compressor 1, and another end is connected to an end of the evaporator 33 through the expansion valve 34. Another end of the evaporator 33 is connected to a suction pipe 20. The scroll compressor 1 compresses refrigerant gas of a low pressure sucked by the suction pipe 20 in a scroll compression part and delivers the refrigerant gas compressed to a high-pressure state from the discharge pipe 21.

The scroll compressor 1 is provided with an unloader mechanism 11 for guiding the refrigerant gas in the process of compression toward a suction port. A control part 31 is provided for operating the unloader mechanism 11. Temperature sensors 37*a* and 37*b* for measuring the temperatures of the fluid (refrigerant) flowing through the evaporator 33 and the condenser 35 respectively are mounted on the evaporator 33 and the condenser 35 respectively. These temperature sensors 37*a* and 37*b* are connected to the control part 31.

A bypass 30 is provided between the discharge pipe 21 and the suction pipe 20, and a pipe branched from an intermediate portion of the bypass is connected to the unloader mechanism 11.

An electromagnetic valve 32 is provided between the branch point and the suction pipe 20 for feeding the refrigerant gas of a high pressure into the unloader mechanism 11. A signal from the control part 31 is input in the electromagnetic valve 32 for opening/closing the same. When the electromagnetic valve 32 is closed, a discharge pressure in the discharge pipe 21 acts on a part of a piston of the unloader mechanism 11 opposite to a side provided with scrolls. When the electromagnetic valve 32 is open, a suction pressure acts on the part of the piston of the unloader mechanism 11. A decompression capillary 36 is provided on the bypass 30 between the discharge pipe 21 and the branch point.

Figure 2:
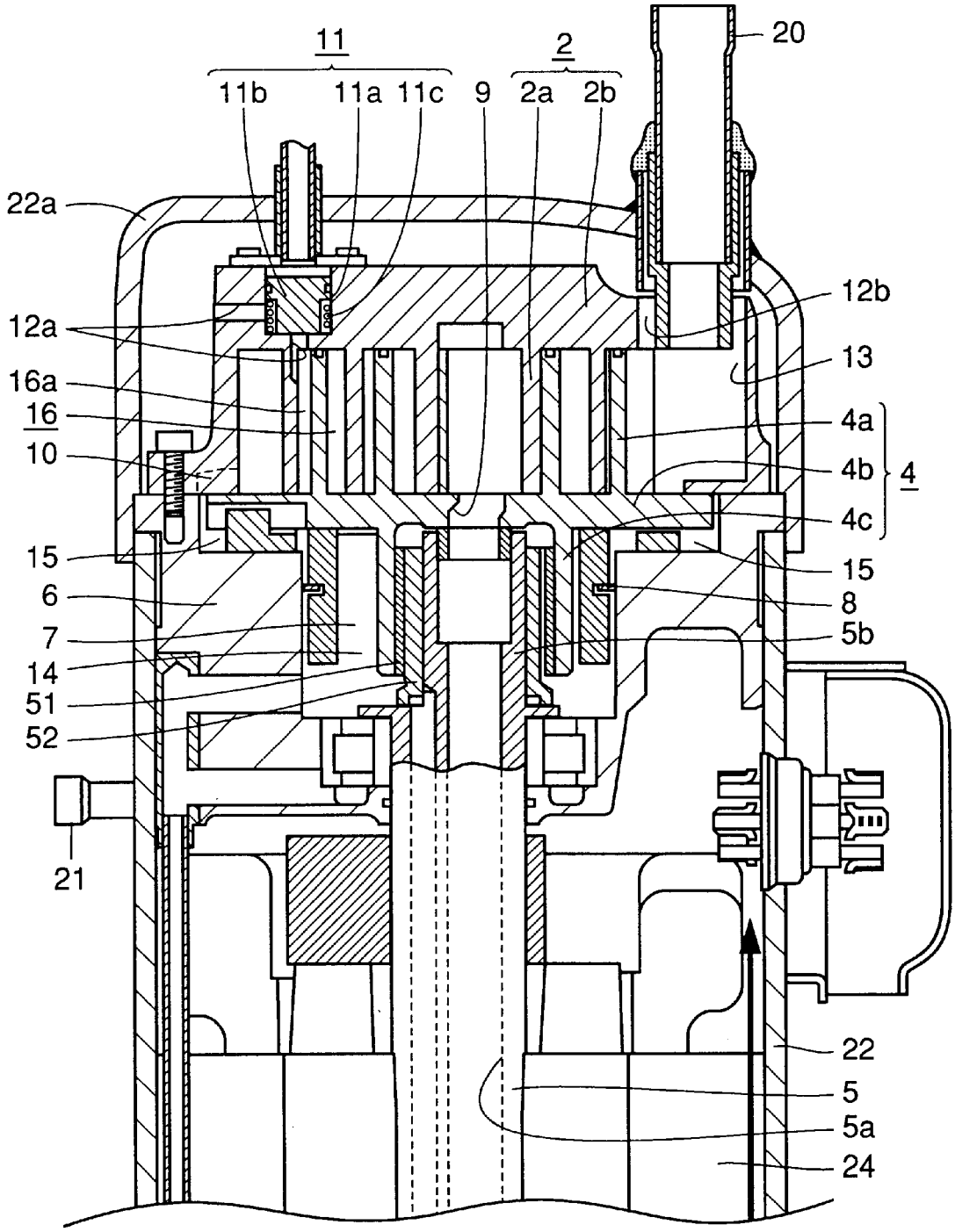
FIG. 2 is a partially fragmented longitudinal sectional view of the scroll compressor according to the first embodiment shown in FIG. 1.

The scroll compressor 1 is now described in more detail. Referring to FIG. 2, a movable scroll 4 and a fixed scroll 2 are supported on an upper portion in a casing 22 of the scroll compressor 1. Movable scroll teeth 4*a* project from an end plate 4*b* of the movable scroll 4. Fixed scroll teeth 2*a* project from an end plate 2*b* of the fixed scroll 2. The movable scroll teeth 4*a* and the fixed scroll teeth 2*a* fit with each other thereby forming a compression chamber 16.

A suction port 13 is provided on the outer peripheral portion of the fixed scroll 2 for introducing the refrigerant gas fed from the suction pipe 20 into the compression chamber 16. A discharge port 9 is provided in the vicinity of the center of the movable scroll 4 for discharging the refrigerant gas compressed to a high-pressure state.

A framework 6 supports the upper end of a drive shaft 5 extending from a motor 24 in the casing 22. An eccentric shaft portion 5*b* of the drive shaft 5 is engaged in an inner hole of a sliding bush 52 rotatably inserted in a bearing pin metal 51 fixed to a boss portion 4*c* provided on the end plate 4*b* of the movable scroll 4.

The drive shaft 5 is formed with a discharge gas passage 5*a* for guiding the refrigerant gas discharged from the discharge port 9 and a discharge gas outlet (not shown). The discharge pipe 21 is provided for delivering the refrigerant gas of a high pressure flowing into the casing 22 from the casing 22.

A first back pressure chamber 14 and a second back pressure chamber 15 are formed between the framework 6 and the movable scroll 4. The first back pressure chamber 14 is a crank chamber 7 storing the boss portion 4*c* and the eccentric shaft portion 5*b*. The second back pressure chamber 15 is formed on the outer periphery of the first back pressure chamber 14. A seal ring 8 seals the first and second back pressure chambers 14 and 15. A high pressure (suction pressure) acts on the first back pressure chamber 14. The refrigerant gas of the suction pressure flows into the second back pressure chamber 15 through a communication hole 10, so that the suction pressure acts on the second back pressure chamber 15.

Therefore, it follows that the discharge pressure acts on a region of the back surface of the end plate 4*b* of the movable scroll 4 located inside the seal ring 8, while the suction pressure acts on a region of the back surface located outside the seal ring 8.

The end plate 2*b* of the fixed scroll 2 is provided with the unloader mechanism 11 for guiding the refrigerant gas from a compression chamber 16*a* in the process of compression toward the suction port 13. The end plate 2*b* is also provided with passages 12*a* and 12*b* for connecting the compression chamber 16*a* with the suction port 13 through a space in a dome 22*a*. The passage 12*a* is formed on its intermediate portion with a cylinder 11*a* having a piston 11*b*. A spring 11*c* is arranged on one side of the piston 11*b*, and the pipe branched from the bypass 30 is connected to another end of the piston 11*b*.

Operation of the aforementioned scroll compressor 1 is now described.

Following rotation of the motor 24, the movable scroll 4 revolves with respect to the fixed scroll 2 so that the compression chamber 16 formed by the movable scroll teeth 4*a* and the fixed scroll teeth 2*a* spirally contractedly moves from the outer peripheral portion toward the central portion.

Thus, the refrigerant gas of a low pressure fed into the compression chamber 16 from the suction pipe 20 through the suction port 13 is compressed to a high-pressure state. The refrigerant gas of a high pressure is discharged from the discharge port 8. The refrigerant gas discharged from the discharge port 8 passes through the discharge gas passage 5*a* provided on the drive shaft 5 and flows into the casing 22 from the discharge gas outlet (not shown).

The refrigerant gas flowing into the casing 22 is delivered from the casing 22 by the discharge pipe 21. The scroll compressor 1 performs such serial compression.

Processing of the control part 31 in the serial compression is now described in detail with reference to a flow chart shown in FIG. 3. The control part 31 detects, calculates or predicts the suction pressure and the discharge pressure at a step S1. First, the control part 31 obtains an evaporating pressure Pe from data of an evaporating temperature Te obtained by the temperature sensor 37*a* provided on the evaporator 33. The control part 31 also obtains a condensing pressure Pc from a condensing temperature Tc obtained by the temperature sensor 37*b* provided on the condenser 35. The suction pressure Ps is substantially equal to the evaporating pressure Pe. The discharge pressure Pd is substantially equal to the condensing pressure Pc. The control part 31 obtains the suction pressure Ps and the discharge pressure Pd in the aforementioned manner.

Then, the control part 31 calculates pressing force and separating force on the basis of the obtained suction pressure Ps and discharge pressure Pd at a step S2. Assuming that Sd represents the area (projected area in the direction of the drive shaft 5) of the end plate 4*b* subjected to the action of the discharge pressure Pd due to the first back pressure chamber 14 and $Ss_1$ represents the area of the end plate 4*b* subjected to the action of the suction pressure Ps due to the second back pressure chamber 15, pressing force Fbp is expressed as follows:

$$Fbp=Pd\cdot Sd+Ps\cdot Ss_1$$

On the other hand, the separating force is obtained as the sum of the products of the pressure acting on the compression chamber 16 and the areas subjected to the action of the pressures. Assuming that Pc represents the pressure in the compression chamber 16 formed by the movable scroll 4 and the fixed scroll 2, Sc represents the area (projected area in the direction of the drive shaft 5) of the end plate 4*b* subjected to the action of the pressure and SS2 represents the area of the end plate 4*b* subjected to the action of the suction pressure Ps, separating force Fth is expressed as follows:

$$Fth=\Sigma Pc\cdot Sc+Ps\cdot Ss_2$$

The pressure Pc in the compression chamber 16 is substantially expressed as follows:

$$Pc=(Vs/Vc)^k\cdot Ps$$

where Vc represents the volume of the compression chamber 16 having the suction pressure Pc, and Vs represents the volume of the compression chamber 16 completing suction (starting compression). These volumes Vc and Vs are geometrically decided by the shapes of the scroll teeth 2*a* and 4*a*. Further, k represents the ratio of specific heat. Thus, the control part 31 obtains the pressing force Fbp and the separating force Fth on the basis of the suction pressure Ps and the discharge pressure Pd.

Then, the control part 31 determines whether or not the separating force is in excess of the pressing force. When determining that the separating force is less than the pressing force, the control part 31 advances to a step S4 and transmits a signal to the electromagnetic valve 32 for closing the same.

When determining that the separating force is in excess of the pressing force at the step S3, the control part 31 advances to a step S5 and transmits a signal to the electromagnetic valve 32 for opening the same. The control part 31 repeats such processing with a proper cycle.

When the scroll compressor 1 is operated at a standard operating pressure ratio in compression, the pressing force is sufficiently large with respect to the separating force as described with reference to the prior art. Therefore, the control part 31 advances from the step S3 to the step S4 and closes the electromagnetic valve 32 or keeps the same in a closed state.

In this case, the discharge pressure Pd acts on the piston 11*b* as a back pressure, and hence the piston 11*b* is pressed downward for inhibiting operation of the unloader mechanism 11. The pressing force is sufficiently large with respect to the separating force, thereby securing adhesion between the scroll teeth 2*a* and 4*a* and the end plates 2*b* and 4*b* and suppressing internal leakage.

When the scroll compressor 1 is operated at a low operating pressure ratio, over-compression takes place and the separating force exceeds the pressing force to operate the unloader mechanism 11. This case is now described in detail.

As hereinabove described, the value of the low operating pressure ratio, smaller than the designed pressure ratio, is not more than about 3. In this case, the discharge pressure Pd is reduced and hence the pressure of the compression chamber 16*a* in the process of compression may be maximized to result in over-compression. Particularly when the operating pressure ratio is not more than 2, over-compression is extremely remarkable.

Distribution of force acting on the end plate 4*b* of the movable scroll 4 at this time is described. On the back surface of the end plate 4*b*, the discharge pressure Pd acts on the region located inside the seal ring 8 while the suction pressure Ps acts on the region located outside the seal ring 8. The pressing force acts on the end plate 4*b* on the basis of these pressures. When the scroll compressor 1 is operated at a low operating pressure ratio, the discharge pressure Pd is reduced and hence the pressing force is reduced below that at standard operating pressure ratio.

On the other hand, the separating force also acts on the end plate 4*b* on the basis of the suction pressure Ps in the suction process, the pressure Pm in the process of compression and the discharge pressure Pd in the discharge process. The discharge pressure Pd is reduced below the pressure Pm in the process of compression, and hence the pressing force is insufficient with respect to the separating force.

If the separating force is to be in excess of the pressing force at this time, the control part 31 transmits a signal to the electromagnetic valve 32 for opening the same. When the electromagnetic valve 32 is open, the suction pressure Ps acts on the piston 11*b* as a back pressure. Then, it follows that the piston 11*b* moves upward due to the elastic force of the spring 11*c*, to connect the compression chamber 16*a* in the process of compression with the suction port 13 through the passage 12*a* and the space in the dome 22*a*.

Figure 4:
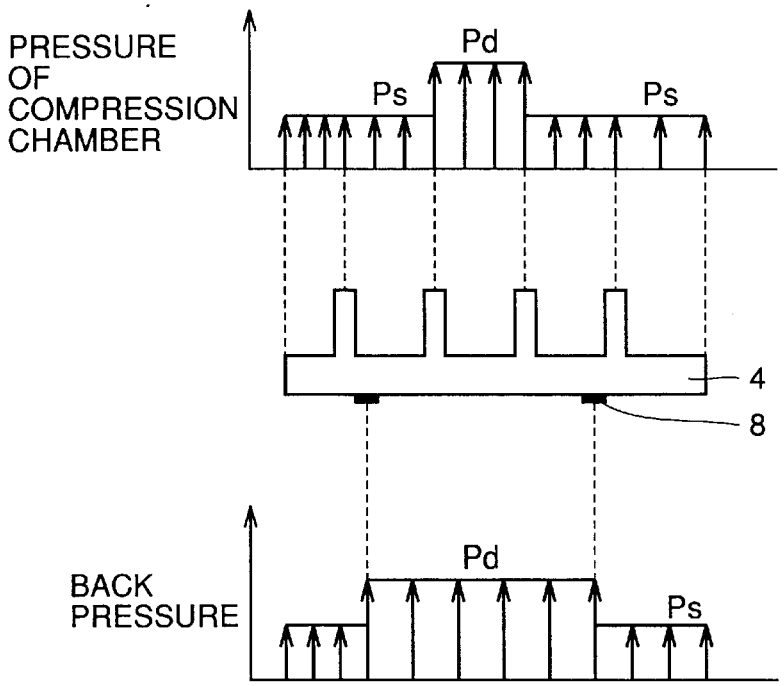
FIG. 4 illustrates pressure distribution in a compression chamber and distribution of back pressure force with respect to positions of a movable scroll in the first embodiment.

In pressure distribution of the compression chamber 16*a* with respect to positions of the end plate 4*b*, therefore, the pressure in the compression chamber 16*a* in the process of compression is reduced to about the suction pressure Ps as shown in FIG. 4, to reduce the separating force.

On the other hand, pressure distribution on the back surface with respect to the positions of the end plate 4*b* remains unchanged before and after operation of the unloader mechanism 11. Also when the pressing force is reduced, relatively sufficient pressing force is attained due to reduction of the separating force so that the scroll teeth 2*a* and 4*a* excellently come into close contact with the opposite end plates 2*b* and 4*b* to be capable of suppressing internal leakage.

The unloader mechanism 11 operates to delay starting of compression and reduce the designed pressure ratio decided by the scroll teeth 2*a* and 4*a*, whereby over-compression is reduced and operation efficiency of the scroll compressor 1 can be improved.

While the control part 31 obtains the evaporating temperature Te and the condensing temperature Tc in order to obtain the suction pressure Ps and the discharge pressure Pd, the suction pressure Ps and the discharge pressure Pd may alternatively be directly detected by setting proper pressure sensors on prescribed positions of the scroll compressor 1 or the refrigerating cycle.

While the control part 31 operates the unloader mechanism 11 by comparing the separating force with the pressing force, the unloader mechanism 11 may alternatively be operated in consideration of the moment of the movable scroll 4 to be inclined with respect to the fixed scroll 2. This is now described.

In the aforementioned scroll compressor 1, the movable scroll teeth 4*a* are formed on one side of the end plate 4*b* of the movable scroll 4 and the boss portion 4*c* is formed on the other side. A portion driving the movable scroll 4 to revolve is separate from a point subjected to a pressure load of the refrigerant gas acting on the movable scroll teeth 4*a* or subjected to centrifugal force acting on the center of gravity of the movable scroll 4. Therefore, a moment inclining the movable scroll 4 with respect to the fixed scroll 2 takes place on the movable scroll 4.

While the pressing force acting on the movable scroll 4 is generally set somewhat large to be capable of not only opposing the separating force based on the pressure in the compression chamber 16*a* but also sufficiently opposing the aforementioned moment, the control part 31 may operate the unloader mechanism 11 when the pressing force cannot oppose the moment. In other words, the control part 31 may operate the unloader mechanism 11 before the movable scroll 4 starts to incline with respect to the fixed scroll 2.

Thus, the pressure of the compression chamber 16*a* in the process of compression is reduced to about the suction pressure Ps, thereby reducing the moment and preventing the movable scroll 4 from inclination with respect to the fixed scroll 2. Consequently, it is possible to prevent internal leakage following inclination of the movable scroll 4 with respect to the fixed scroll 2.

Alternatively, the control part 31 may detect time change of the evaporating temperature Te or the condensing temperature Tc in the refrigerating cycle for operating the unloader mechanism 11 before the pressing force gets insufficient.

In the aforementioned scroll compressor 1, the spring 11*c* is preferably set to relatively small elastic force so that the piston 11*b* can move downward against the elastic force of the unloader mechanism 11 also when the discharge pressure Pd is low and the control part 31 does not operate the unloader mechanism 11 to reduce the flow rate of discharged refrigerant gas when both of the suction pressure Ps and the discharge pressure Pd are low as in the case of defrost operation. The defrost operation can be prevented from prolongation by keeping the unloader mechanism 11 unoperated.

Second Embodiment

Figure 5:
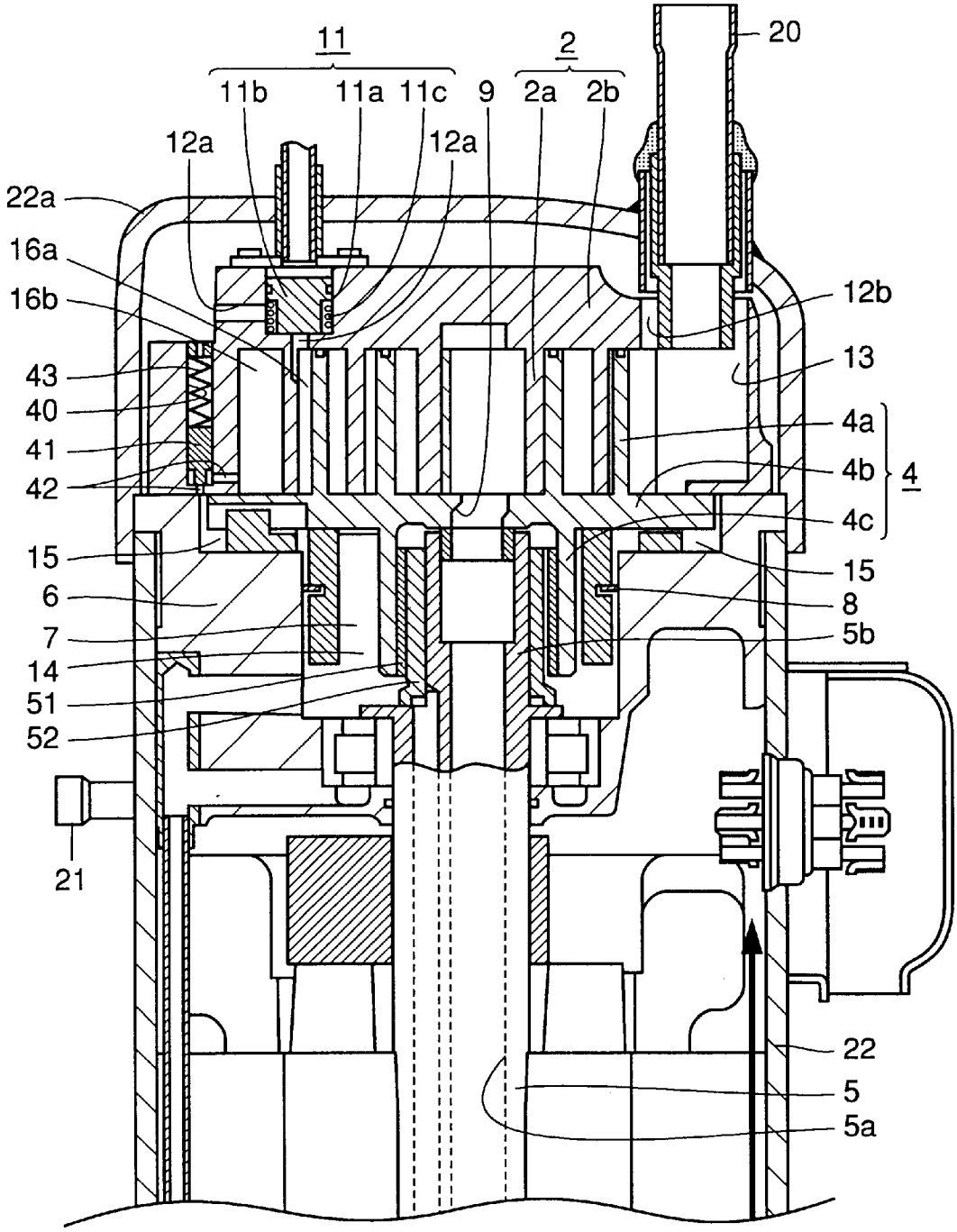
FIG. 5 is a partially fragmented longitudinal sectional view of a scroll compressor according to a second embodiment of the present invention.
Figure 6:
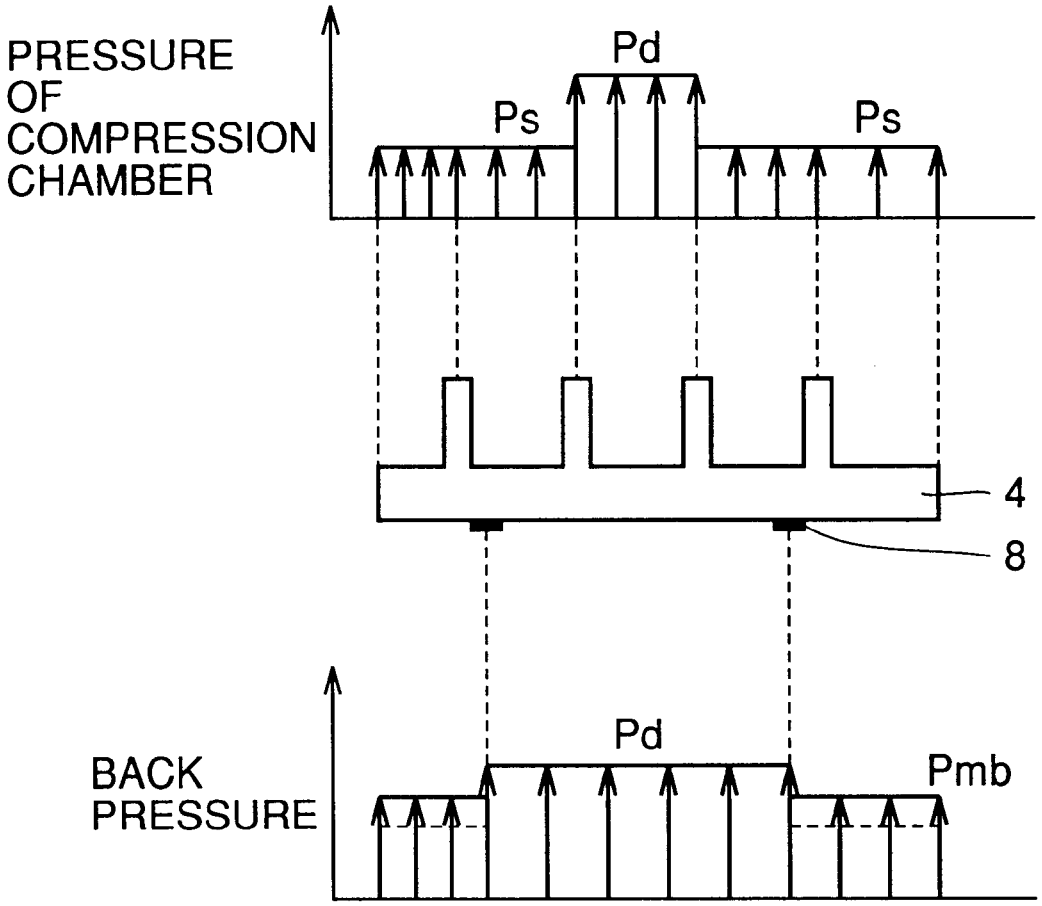
FIG. 6 illustrates pressure distribution in a compression chamber and distribution of back pressure force with respect to positions of a movable scroll in the second embodiment.

A scroll compressor according to a second embodiment of the present invention is now described. Referring to FIG. 5, this scroll compressor guides refrigerant gas etc. of an intermediate pressure Pmb lower than a discharge pressure Pd to a second back pressure chamber 15 in particular. A fixed scroll 2 is formed with a passage 42 for guiding the refrigerant gas from the second back pressure chamber 15 to a suction pressure chamber 16*b* or a compression chamber having a pressure close to a suction pressure Ps provided on the outermost periphery of the fixed scroll 2.

The passage 42 is formed on its intermediate portion with a cylinder 40 having a piston 41. A spring 43 is arranged on one side of the piston 41 so that the suction pressure Ps and the elastic force of the spring 43 act on the piston 41. The pressure of the second back pressure chamber 15 acts on another side of the piston 41 as a piston back pressure.

Refrigerant gas of a high pressure flows from a first back pressure chamber 14 into the second back pressure chamber 15 through a clearance in the vicinity of a seal ring 8 in a decompressed state. In addition to the refrigerant gas, lubricating oil, substantially having a discharge pressure Pd, supplied to a boss portion 4*c* or the like also flows into the second back pressure chamber 15. This scroll compressor is connected with a control part 31 and other elements similar to those shown in FIG. 1.

The remaining structure of the second embodiment is similar to that of the scroll compressor 1 shown in FIGS. 1 and 2 described with reference to the first embodiment. Therefore, components of the second embodiment identical to those of the first embodiment are denoted by the same reference numerals, and redundant description is not repeated.

Serial compression of this scroll compressor is similar to the compression of the scroll compressor 1 described with reference to the first embodiment. In this compression, the control part 31 performs prescribed processing along the flow chart shown in FIG. 3.

When the scroll compressor is operated at a standard operating pressure ratio, pressing force is sufficiently large with respect to separating force and hence an unloader mechanism 11 remains unoperated as described with reference to the first embodiment. Adhesion between scroll teeth 2*a* and 4*a* and end plates 2*b* and 4*b* is secured to suppress internal leakage due to the pressing force sufficiently large with respect to the separating force.

When the scroll compressor is operated at a low operating pressure ratio, the unloader mechanism 11 operates. This case is now described in detail.

In this scroll compressor, the refrigerant gas of a high pressure flows from the first back pressure chamber 14 into the second back pressure chamber 15 through the clearance in the vicinity of the seal ring 8 in a decompressed state, in particular. The pressure in the second back pressure chamber 15 is increased due to the refrigerant gas flowing therein.

When the pressure in the second back pressure chamber 15 exceeds the sum of the elastic force of the spring 43 and the suction pressure Ps acting on the piston 41, it follows that the piston 41 moves upward to connect the first back pressure chamber 14 with the suction pressure chamber 16*b* or the compression chamber of a pressure close to the suction pressure Ps provided on the outermost periphery of the scroll 2 through the passage 42. The refrigerant gas flows from the second back pressure 15 into the suction pressure chamber 16*b*.

The pressure in the second back pressure chamber 15 is reduced due to the refrigerant gas flowing into the suction pressure chamber 16*b*, and the piston 41 moves downward to close the passage 42. The refrigerant gas flows into the second back pressure chamber 15 through the clearance in the vicinity of the seal ring 8. The scroll compressor repeats similar operation thereby keeping the pressure in the second back pressure chamber 15 at the intermediate pressure Pmb between the discharge pressure Pd and the suction pressure Ps.

When the scroll compressor is operated at a low operating pressure ratio, the unloader mechanism 11 operates to guide the refrigerant gas from a compression chamber 16*a* toward a suction port 13. Thus, separating force acts on the end plate 4*b* on the basis of the suction pressure Ps in a suction process and the discharge pressure Pd in a discharge process.

On the other hand, pressing force also acts on the back surface of the end plate 4*b* on the basis of the discharge pressure Pd in the first back pressure chamber 14 and the intermediate pressure Pmb in the second back pressure chamber 15. The separating force is substantially identical to that in the scroll compressor 1 according to the first embodiment. As to the pressing force, however, the second back pressure chamber 15 has the intermediate pressure Pmb between the discharge pressure Pd and the suction pressure Ps.

As compared with the scroll compressor 1 according to the first embodiment having the corresponding pressure of the suction pressure Ps, therefore, the pressing force is stronger and the scroll teeth 2*a* and 4*a* further excellently come into close contact with the opposing end plates 2*b* and 4*b* to be capable of effectively suppressing internal leakage.

In this scroll compressor, it is possible to prevent such inconvenience that the pressing force gets excessive as compared with the separating force to reduce compression efficiency particularly in the case of a high operating pressure ratio or the scroll teeth 2*a* and 4*a* seize to the opposing end plates 2*b* and 4*b* by so selecting the spring constant of the spring 43 as to adjust the second back pressure chamber 15 to a proper pressure and adjusting pressure receiving areas of the first and second back pressure chambers 14 and 15.

This scroll compressor can also attain an effect similar to that described with reference to the first embodiment by controlling the unloader mechanism 11 in consideration of a moment related to inclination of a movable scroll 4 or defrost operation.

Third Embodiment

A third embodiment of the present invention is described with reference to a scroll compressor capable of automatically operating an unloading mechanism.

Figure 7:
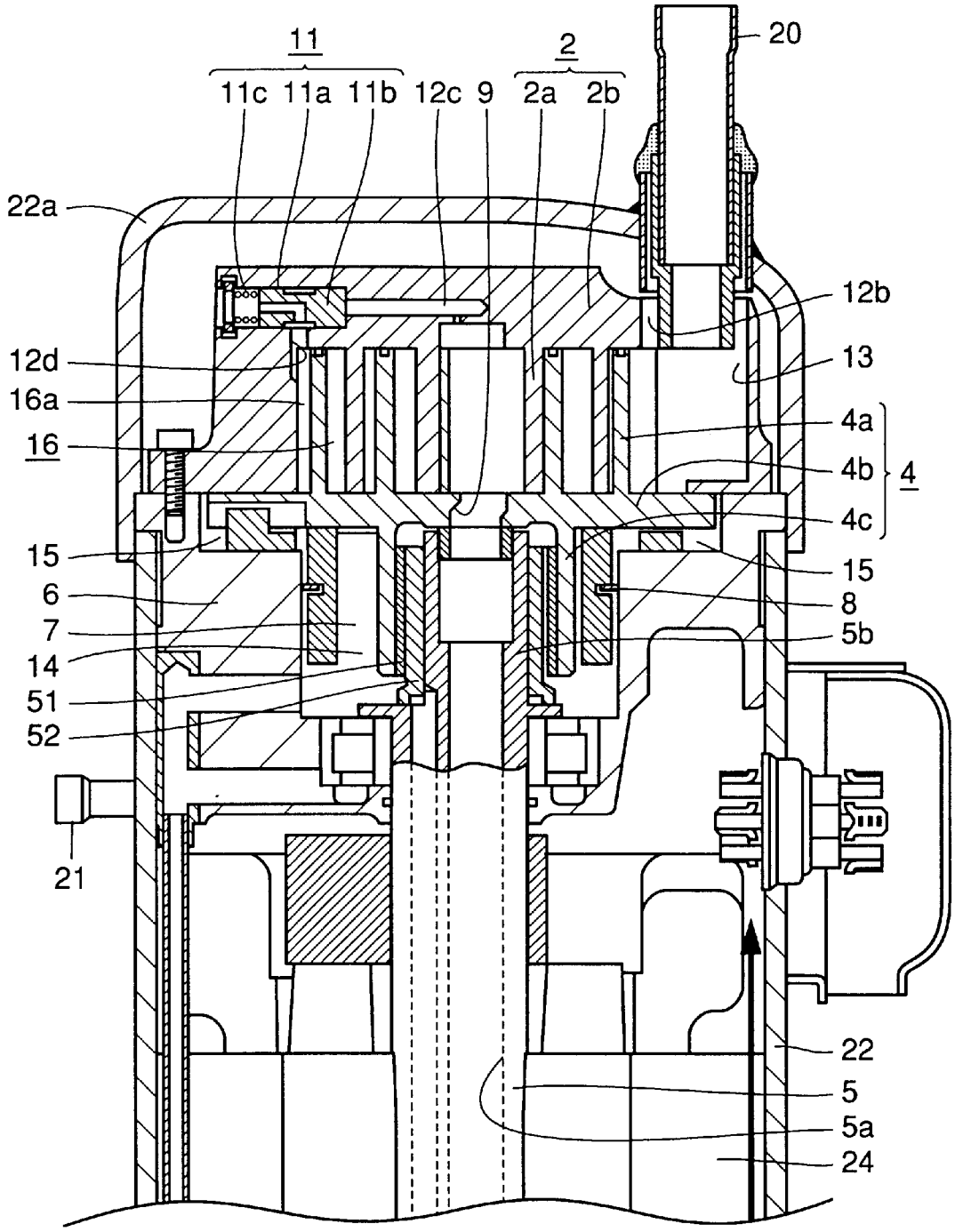
FIG. 7 is a partially fragmented longitudinal sectional view of a scroll compressor according to a third embodiment of the present invention.
Figure 8:
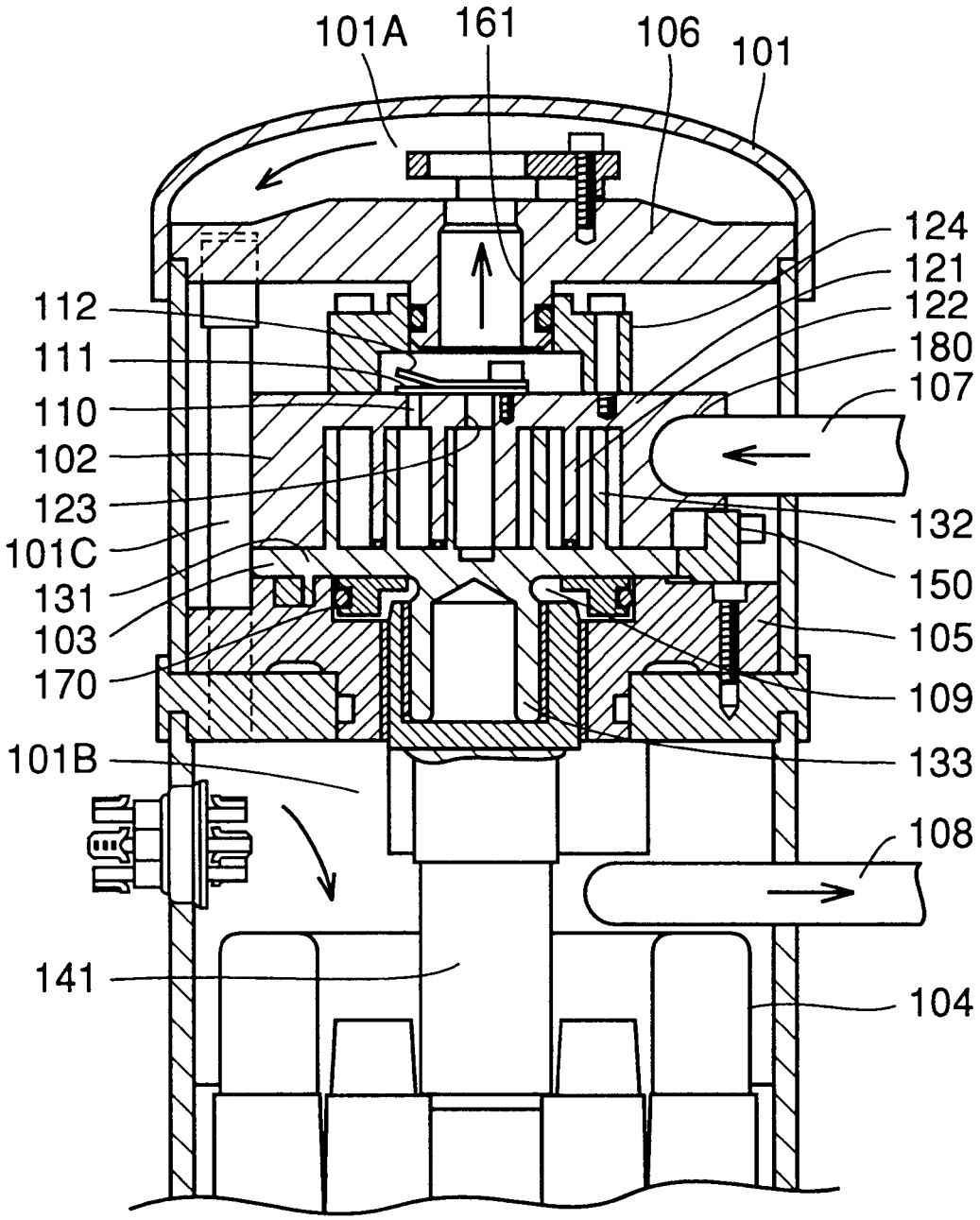
FIG.8 PRIOR ART
FIG. 8 is a partially fragmented sectional view of a conventional scroll compressor.
Figure 9:
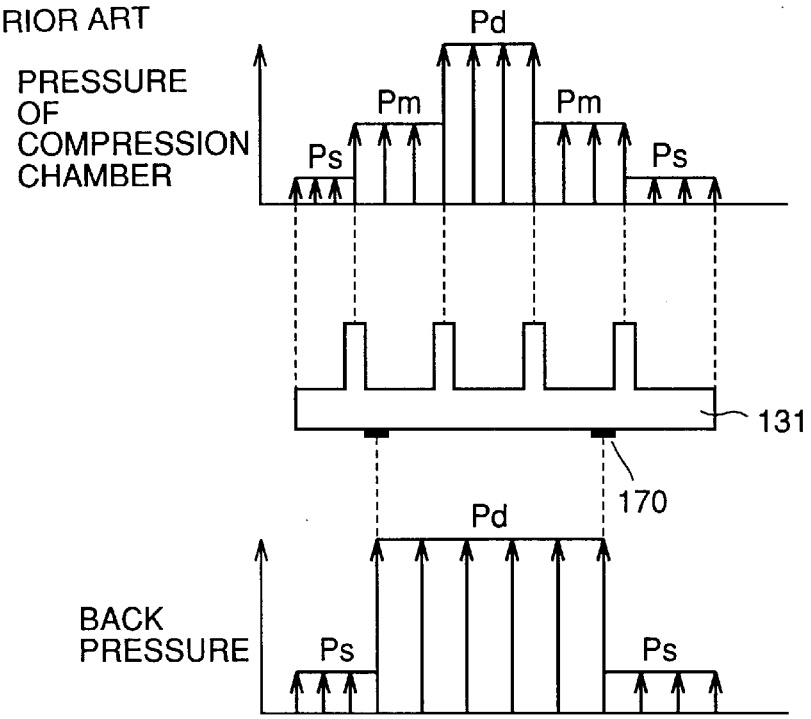
FIG.9 PRIOR ART
FIG. 9 illustrates pressure distribution in a compression chamber and distribution of back pressure force with respect to positions of a movable scroll in the conventional scroll compressor.
Figure 10:
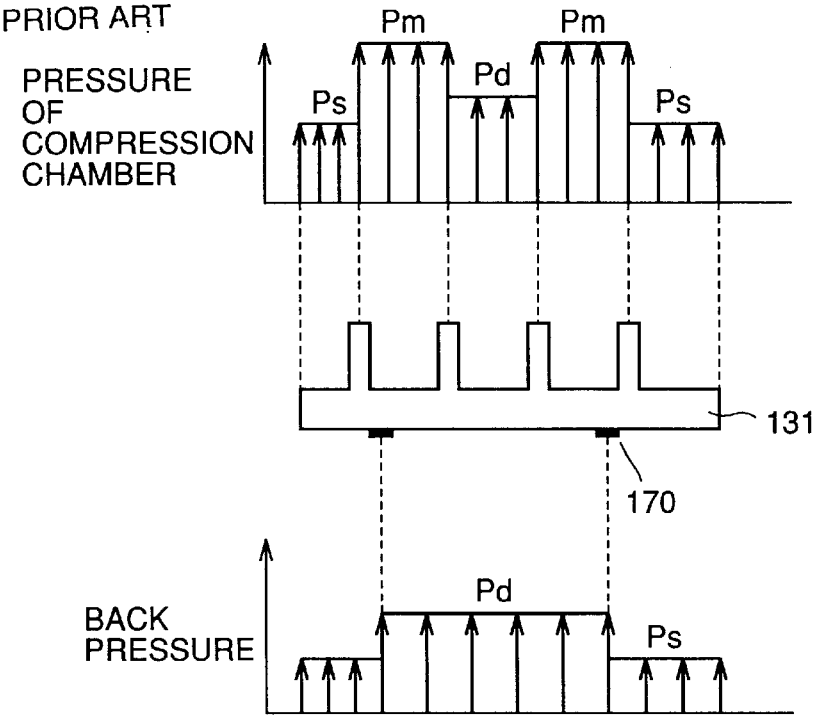
FIG.10 PRIOR ART
FIG. 10 illustrates pressure distribution in the compression chamber and distribution of back pressure force with respect to the positions of the movable scroll in the conventional scroll compressor for illustrating a problem.

Referring to FIG. 7, an unloader mechanism 11 is provided on an end plate 2*b* of a fixed scroll 2. The end plate 2*b* is provided with a passage 12*b* for connecting a compression chamber 16*a* with a suction port 13 through a space in a dome 22*a*. The passage 12*b* is formed on an intermediate portion with a cylinder 11*a* having a piston 11*b*.

A spring 11*c* is arranged on one side of the piston 11*b* so that a suction pressure Ps and the elastic force of the spring 11*c* act on the piston 11*b*. Another side of the piston 11*b* communicates with a compression chamber in a discharge process, so that a discharge pressure Pd substantially acts as a piston back pressure. The fixed scroll 2 is provided with a communication passage connecting a second back pressure chamber 15 with the suction port 13. The remaining structure of the third embodiment is similar to that of the scroll compressor 1 described with reference to the first embodiment. Therefore, components of the third embodiment identical to those shown in FIG. 1 are denoted by the same reference numerals, and redundant description is not repeated.

Serial compression of this scroll compressor is also similar to the compression of the scroll compressor 1 described with reference to the first embodiment.

When the scroll compressor is operated at a standard operating pressure ratio, the discharge pressure Pd is relatively large and hence force acting on a pressure receiving surface of the piston 11*b* on the basis of the difference between the discharge pressure Pd and the suction pressure Ps is larger than the elastic force of the spring 11*c*.

In this case, therefore, the piston 11*b* is located on the left end in FIG. 7 so that the unloader mechanism 11 remains unoperated. Thus, the compression chamber 16*a* is sealed and has an intermediate pressure Pm in the process of compression.

Pressing force is so sufficiently large with respect to separating force as to secure adhesion between scroll teeth 2*a* and 4*a* and end plates 2*b* and 4*b* and suppress internal leakage.

When the scroll compressor is operated at a low operating pressure ratio, the unloader mechanism 11 automatically operates. This case is described in detail.

When the scroll compressor is operated at a low operating pressure ratio, the discharge pressure Pd is reduced and hence the pressure in the compression chamber 16*a* in the process of compression may be maximized to result in over-compression.

When the discharge pressure Pd is reduced below the pressure Pm in the process of compression and the force acting on the pressure receiving surface of the piston 11*b* on the basis of the difference between the discharge pressure Pd and the suction pressure Ps is also reduced below the elastic force of the spring 11*c*, the piston 11*b* is automatically displaced rightward in FIG. 7 to operate the unloader mechanism 11. Thus, the compression chamber 16*a* communicates with the suction port 13, and the pressure in the compression chamber 16*a* substantially reaches the suction pressure Ps.

Figure 3:
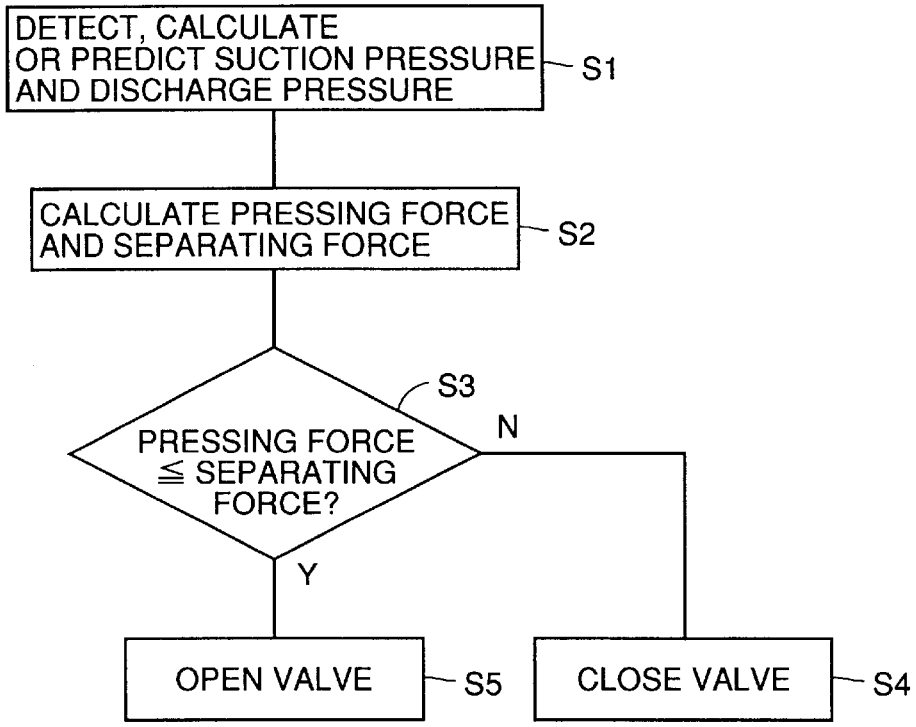
FIG. 3 is a flow chart of a control part according to the first embodiment.

In this case, therefore, pressure distribution in the compression chamber 16*a* acting on the end plate 4*b* of the movable scroll 4 is substantially identical to the distribution shown in FIG. 3.

In pressure distribution of a back surface chamber acting on the end plate 4*b*, the discharge pressure Pd acts on a region located inside a seal ring 8 and the suction pressure Ps acts on a region located outside the seal ring 8, as described with reference to the first embodiment. Pressing force acts on the end plate 4*b* on the basis of these pressures. This pressing force remains unchanged before and after operation of the unloader mechanism 11.

Thus, the pressure Pm in the compression chamber 16*a* is reduced to about the suction pressure Ps to also reduce the separating force. Further, over-compression is relaxed due to the reduction of the pressure Pm in the compression chamber 16*a*.

Also when the pressing force is reduced, therefore, relatively sufficient pressing force is attained due to reduction of the separating force, and the scroll teeth 2*a* and 4*a* excellently come into close contact with the opposing end plates 2*b* and 4*b* to be capable of suppressing internal leakage.

The spring 11*c* of the unloader mechanism 11 preferably has relatively small elastic force. This is now described.

When both of the discharge pressure Pd and the suction pressure Ps are low in defrost operation, for example, and the elastic force of the spring 11*c* is large as compared with the force based on these pressures, the elastic force of the spring 11*c* gets dominant.

In this case, the piston 11*c* automatically moves rightward in FIG. 7 due to the elastic force of the spring 11*c* even if the operating pressure ratio is large, to disadvantageously operate the unloader mechanism 11.

Thus, it follows that a long time is required for defrost operation. When the scroll compressor is operated at a high speed by inverter control in this case, a motor must be rotated at an extremely high speed due to a small quantity of discharge in the defrost operation, to result in problems of reliability of the motor, noise and vibration.

Therefore, the spring 11*c* preferably has such small elasticity that the unloader mechanism 11 remains unoperated to a degree not remarkably separating the scroll teeth 2*a* and 4*a* from the opposing end plates 2*b* and 4*b* under a low operating pressure ratio.

Thus, the unloader mechanism 11 remains operated in defrost operation due to the aforementioned spring 11*c*, so that the defrost operation can be ended in a short time.

The scroll compressor may be provided with a prescribed mechanism for guiding a fluid from a first back pressure chamber 14 into a second back pressure chamber 15 through a clearance in the vicinity of a seal ling 8 in a decompressed state while keeping the pressure in the second back pressure chamber 15 between the suction pressure Ps and the discharge pressure Pd, similarly to the scroll compressor described with reference to the second embodiment.

Also in this case, a back pressure corresponding to the second back pressure chamber 15 is increased to further increase the pressing force so that the scroll teeth 2*a* and 4*a* further excellently come into close contact with the opposing end plates 2*b* and 4*b* to be capable of effectively suppressing internal leakage.

While the movable scroll is pressed against the fixed scroll in each of the aforementioned embodiments, internal leakage can be suppressed also in a structure pressing the fixed scroll against the movable scroll by providing the aforementioned control part, unloader mechanism and the like.

Further, each of the aforementioned scroll compressors may be provided with a relief port (not shown) and a relief valve (not shown) releasing the refrigerant gas from the compression chamber in the process of compression toward the suction port, similarly to the conventional scroll compressor.

The relief port and the relief valve suppress over-compression while the unloader mechanism 11 reduces the pressure of the compression chamber following (outside) the compression chamber communicating with the passages 12*a* and 12*d* to about the suction pressure, whereby sufficient pressing force is attained with respect to the separating force and internal leakage can be more reliably suppressed as compared with the conventional scroll compressor.

Also when operating the unloader mechanism 11, the scroll compressor may cause over-compression when the operating pressure ratio is extremely small. In this case, the refrigerant gas is released from the compression chamber causing over-compression toward the suction port 13, so that the over-compression can be relaxed.

Defrost operation can be ended in a shorter time by employing variable-speed electric motor (inverter control) as an electric motor for driving the scroll compressor and increasing the rotational frequency of the electric motor in the defrost operation without operating the unloader mechanism thereby increasing the quantity of discharge of the scroll compressor.

When the operating pressure ratio is low, it is generally preferable that a refrigerating air conditioner has a small thermal load and a scroll compressor has a small quantity of discharge in consideration of reduction of power consumption. The inventive scroll compressor attains a proper quantity of discharge by reducing the rotational frequency of the motor 24 by inverter control and operating the unloader mechanism 11 thereby enabling efficient compression with small over-compression.

While the unloader mechanism 11 is provided on the passage connecting the compression chamber 16*a* in the process of compression with the suction pressure chamber or the suction port in each of the aforementioned embodiments, this passage is preferably provided to connect a chamber formed on the outermost periphery of the scroll for starting compression with a chamber of a state progressing compression to some extent, in order to minimize pre-compression loss.

The present invention is effectively applicable to a structure for reducing internal leakage of a scroll compressor.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A scroll compressor comprising:

a fixed scroll (2) and a movable scroll (4) for forming a compression chamber (16, 16*a*);

a suction port (13) for sucking a fluid into said compression chamber (16, 16*a*);

a discharge port (9) for discharging said fluid compressed in said compression chamber (16, 16*a*);

an unloader part (11) for guiding said fluid from said compression chamber (16*a*) in the process of compression toward said suction port (13);

control means (31) capable of operating said unloader part (11); and a first back pressure chamber (14) provided on the back surface of either said fixed scroll (2) or said movable scroll (4) for receiving said fluid, having a discharge pressure, discharged from said discharge port (9), wherein said control means (31) detects, calculates or predicts a suction pressure or said discharge pressure, compares separating force for separating said fixed scroll (2) and said movable scroll (4) from each other with pressing force for pressing one said scroll against another said scroll on the basis of detected, calculated or predicted said suction pressure and said discharge pressure, and operates said unloader part (11) when said pressing force is insufficient or to be insufficient with respect to said separating force for releasing said fluid from said compression chamber (16*a*) in the process of compression toward said suction port (13).

2. The scroll compressor according to claim 1, wherein said control means (31) calculates or predicts said discharge pressure and said suction pressure from the temperatures of said fluid flowing through an evaporator (33) and a condenser (35) connected between a discharge pipe (21) delivering discharged said fluid and a suction pipe (20) receiving said fluid respectively on the outside of a casing (22).

3. The scroll compressor according to claim 1, wherein said unloader part (11) has a first switching part (11) provided on an intermediate portion of a first passage (12*a*, 12*b*) connecting said compression chamber (16*a*) in the process of compression with a region located on the side of said suction port (13) for opening/closing said first passage (12*a*) with said fluid of said discharge pressure or said fluid of said suction pressure, for opening said first switching part (11) by guiding said fluid of said suction pressure to said first switching part (11); and closing said first switching part (11) by guiding said fluid of said discharge pressure to said first switching part (11).

4. The scroll compressor according to claim 1, further comprising a second back pressure chamber (15) receiving said fluid of said discharge pressure in a decompressed state on the back surface of either said scroll.

5. The scroll compressor according to claim 4, further comprising a sealing member (8) sealing said first back pressure chamber (14) and said second back pressure chamber (15), wherein said fluid of said discharge pressure is decompressed by flowing from said first back pressure chamber (14) into said second back pressure chamber (15) through a clearance in the vicinity of said sealing member (8).

6. The scroll compressor according to claim 1, wherein an electric motor (24) for driving said movable scroll (4) is a variable-speed electric motor (24).

7. The scroll compressor according to claim 1, further comprising:

a relief port for directly guiding said fluid in said compression chamber in the process of compression to a region located on the side of said discharge port (9), and a relief valve provided on an intermediate portion or the outlet of said relief port for opening said relief port when the pressure in said compression chamber in the process of compression exceeds the pressure on the side of said discharge port.

8. A scroll compressor comprising:

a fixed scroll (2) and a movable scroll (4) for forming a compression chamber (16, 16*a*);

a suction port (13) for sucking a fluid into said compression chamber (16, 16*a*);

a discharge port (9) for discharging said fluid compressed in said compression chamber (16, 16*a*);

an unloader part (11) for guiding said fluid from said compression chamber (16*a*) in the process of compression toward said suction port (13); and a first back pressure chamber (14) provided on the back surface of either said fixed scroll (2) or said movable scroll (4) for receiving said fluid, having a discharge pressure, discharged from said discharge port (9), wherein said unloader part (11) includes a switching part (11) opened/closed by working said discharge pressure on one side of a piston part (11*b*) while working a suction pressure and elastic force on another side, and said switching part (11) is opened for releasing said fluid from said compression chamber (16*a*) toward said suction port (13) when said discharge pressure is smaller than said suction pressure and said elastic force.

9. The scroll compressor according to claim 8, further comprising a second back pressure chamber provided on the back surface of either said scroll for receiving said fluid of said discharge pressure in a decompressed state.

10. The scroll compressor according to claim 9, further comprising a sealing member (8) sealing said first back pressure chamber (14) and said second back pressure chamber (15), wherein said fluid of said discharge pressure is decompressed by flowing from said first back pressure chamber (14) into said second back pressure chamber (15) through a clearance in the vicinity of said sealing member (8).

* * * * *